US011427371B1

(12) United States Patent
Davidson

(10) Patent No.: US 11,427,371 B1
(45) Date of Patent: Aug. 30, 2022

(54) DECORATIVE PET FOOD CONTAINER ASSEMBLY

(71) Applicant: Alexis Davidson, Wilmington, NC (US)

(72) Inventor: Alexis Davidson, Wilmington, NC (US)

( * ) Notice: Subject to any disclaimer, the term of this patent is extended or adjusted under 35 U.S.C. 154(b) by 0 days.

(21) Appl. No.: 16/917,444

(22) Filed: Jun. 30, 2020

Related U.S. Application Data

(63) Continuation of application No. 16/223,682, filed on Dec. 18, 2018, now Pat. No. 10,723,501.

(51) Int. Cl.
*B65D 43/16* (2006.01)
*B65D 1/16* (2006.01)

(52) U.S. Cl.
CPC ..... *B65D 1/16* (2013.01); *B65D 43/163* (2013.01); *B65D 2203/00* (2013.01)

(58) Field of Classification Search
CPC ..... B65D 1/16; B65D 43/163; B65D 2203/00
USPC ..... 119/51.01; 206/457
See application file for complete search history.

(56) References Cited

U.S. PATENT DOCUMENTS

| | | | |
|---|---|---|---|
| D445,968 | S | 7/2001 | Kaplan |
| 8,235,215 | B2 | 8/2012 | Tomasello et al. |
| 8,544,412 | B1 | 10/2013 | Haverstock |
| 8,851,013 | B2 | 10/2014 | Tsengas |
| 2004/0237398 | A1 | 12/2004 | Weder |
| 2008/0210586 | A1 | 9/2008 | Didio |
| 2010/0243503 | A1 | 9/2010 | Krueger et al. |
| 2010/0300364 | A1 | 12/2010 | Sena et al. |
| 2011/0031142 | A1 | 2/2011 | Lindeman |
| 2011/0057019 | A1 | 3/2011 | Spencer et al. |
| 2011/0315567 | A1 | 12/2011 | Boynton et al. |
| 2012/0055597 | A1 | 3/2012 | Aznar-Meyer et al. |

(Continued)

FOREIGN PATENT DOCUMENTS

| | | | |
|---|---|---|---|
| JP | H09188098 | A | 7/1997 |
| JP | 2000025844 | A | 1/2000 |

OTHER PUBLICATIONS

Decorative Dog Food Container—http://www.lowes.com/creative-ideas/organize-store-and-move/decorative-dog-food-container/project.

(Continued)

*Primary Examiner* — Jacob K Ackun
(74) *Attorney, Agent, or Firm* — Schacht Law Office, Inc.; Paul J. Nykaza

(57) ABSTRACT

A decorative container assembly (10) has a container (12) having a bottom member (18) and an annular sidewall (20) extending from the bottom member (18). An end of the annular sidewall (20) defines a rim (22) and an opening (24) of the container (12). A first decorative member (16) is adhered to the sidewall (20) and covers an outer surface of the sidewall (20). The decorative container assembly (10) further has a lid assembly (14) operably removably connected to the rim (22) of the container (12). The lid assembly (14) has an annular ring member (42) and a top cover member (44). A second decorative member (16) covers a top surface of the cover member (44). A handle (34) has a first end connected to the sidewall (20) at a first position and a second end connected to the sidewall (20) at a second position, the first position being generally opposite to the second position. A first earing member (88) hangs from the handle (34) proximate the first end of the handle (34) and proximate the sidewall (20), and a second earing member (94) hangs from the handle (34) proximate the second end of the handle (34) and proximate the sidewall (20).

26 Claims, 14 Drawing Sheets

(56) References Cited

U.S. PATENT DOCUMENTS

| | | | |
|---|---|---|---|
| 2013/0334377 | A1 | 12/2013 | Lee |
| 2014/0116910 | A1 | 5/2014 | Monjello et al. |
| 2016/0083137 | A1 | 3/2016 | Serras et al. |

OTHER PUBLICATIONS

Dog Toile Food Storage Canister—http://www.harrybarker.com/eat/dog-food-storage/toile-dog-foodstorage-canister.html.
Food Containers and Bins—http://animalfare.co.uk/home-2/pet-foods/.
Gamma Seal Lid—http://www.gamma2.net/gamma-seal-lid.htm.
Vittles Vault 2 Gallon Container & Gamma Lid—Pink Faux Fur—Free Shipping—http://www.bayteccontainers.com/2-gal-faux-fur-covvers-pink-with-gamma-seal-spin-top-andscoop.html#gsc.tab=0.

DECORATIVE PET FOOD CONTAINER ASSEMBLY

CROSS-REFERENCE TO RELATED APPLICATIONS

The present application is a continuation application of U.S. patent application Ser. No. 16/223,682, filed on Dec. 18, 2018, which application is incorporated by reference herein and made a part hereof.

FEDERALLY SPONSORED RESEARCH OR DEVELOPMENT

None.

TECHNICAL FIELD

The invention relates generally to a container and, in particular, to a decorative container assembly having a plurality of decorative elements that in one exemplary embodiment, is a pet food container.

BACKGROUND OF THE INVENTION

Container assemblies are used for a variety of different uses and purposes. In certain applications, a container assembly may take the form of a bucket such as a five-gallon bucket known in the art. Five-gallon buckets are used in several different applications such as for containing liquids, powders, other flowable materials and also solid objects or other items. Other containers can take the form of plastic bins having a re-attachable lid. One such application for plastic bins is for pet food containers. In such an application, it is important for the containers to able to be tightly closed and selectively opened as needed. While the containers serve a primarily utilitarian purpose in holding pet food, for example, the containers are often not visually aesthetically pleasing to a homeowner or others. As such, some homeowners seek to store such containers away from view such as in closets or cupboards. In certain households, however, such storage areas are not possible. Accordingly, it would be desirable to have a container assembly that is functional for holding pet food, but that is more visually aesthetically pleasing and, therefore, could be placed in areas that are not hidden from view to a homeowner or others.

While such container assemblies according to the prior art provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a decorative container assembly that can be used in a variety of applications including as a pet food container.

According to a first aspect of the invention, the decorative container assembly has a container having a bottom member and an annular sidewall extending from the bottom member. An end of the annular sidewall defines a rim and an opening of the container. A first decorative member is adhered to the sidewall and covers an outer surface of the sidewall in an exemplary embodiment. A lid assembly is operably removably connected to the rim of the container, and the lid assembly has an annular ring and a top member. A second decorative member covers a top surface of the top member. A handle has a first end connected to the sidewall at a first position and a second end connected to the sidewall at a second position, the first position being generally opposite to the second position. A first earing member hangs from the handle proximate the first end of the handle and proximate the sidewall, and a second earing member hangs from the handle proximate the second end of the handle and proximate the sidewall.

According to another aspect of the invention the container of the container assembly is a five-gallon bucket. The bucket can be made from food grade safe material. In a further embodiment, the bucket is made from a bisphenol-free material.

According to another aspect of the invention, an external surface of the bottom member of the container is painted.

According to a further aspect of the invention, an upper segment of the sidewall of the container is painted.

According to another aspect of the invention, the lid assembly is a gamma seal lid wherein the annular ring and the top member are not integrally connected. The annular ring member is connected to the rim and has a gasket positioned between an inner surface of the ring member and the rim, the cover member being removably connected to the annular ring member by mating threads between the ring member and the top member, the top member has intersecting cross-members and having a plurality of recessed segments between the cross-members. In a further aspect, the annular ring is painted.

According to another aspect of the invention, the first decorative member is a paper-based member adhered to the sidewall in a decoupage configuration. The first decorative member is adhered to the sidewall with mod podge glue.

According to another aspect of the invention, the first decorative member has a pattern thereon. The pattern can comprise a plurality of patterns. In further exemplary embodiments, the second decorative member has a pattern thereon. The first decorative member and the second decorative member have a clear coat layer applied thereon.

According to another aspect of the invention, the handle has a first end connected to the sidewall and a second end connected to the sidewall generally opposite to the first end of the handle, wherein each earing member has a jewel member attached thereto and a clasp member that is removably attached to the handle. The handle has a grip member thereon.

According to yet another aspect of the invention, the handle has a first stop member positioned on the handle adjacent the first end of the handle and a second stop member positioned on the handle adjacent the second end of the handle, the first earing ember is positioned between the first stop member and the container and the second earing member is positioned between the second stop member and the container.

According to another aspect of the invention, the cover member defines an undulating top surface having an outer lip member and an inner circular member, wherein the second decorative member includes a painted layer on the outer lip member and a second decorative pattern member positioned on the inner circular member. A further decorative element can be positioned generally in a center of the inner circular member.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
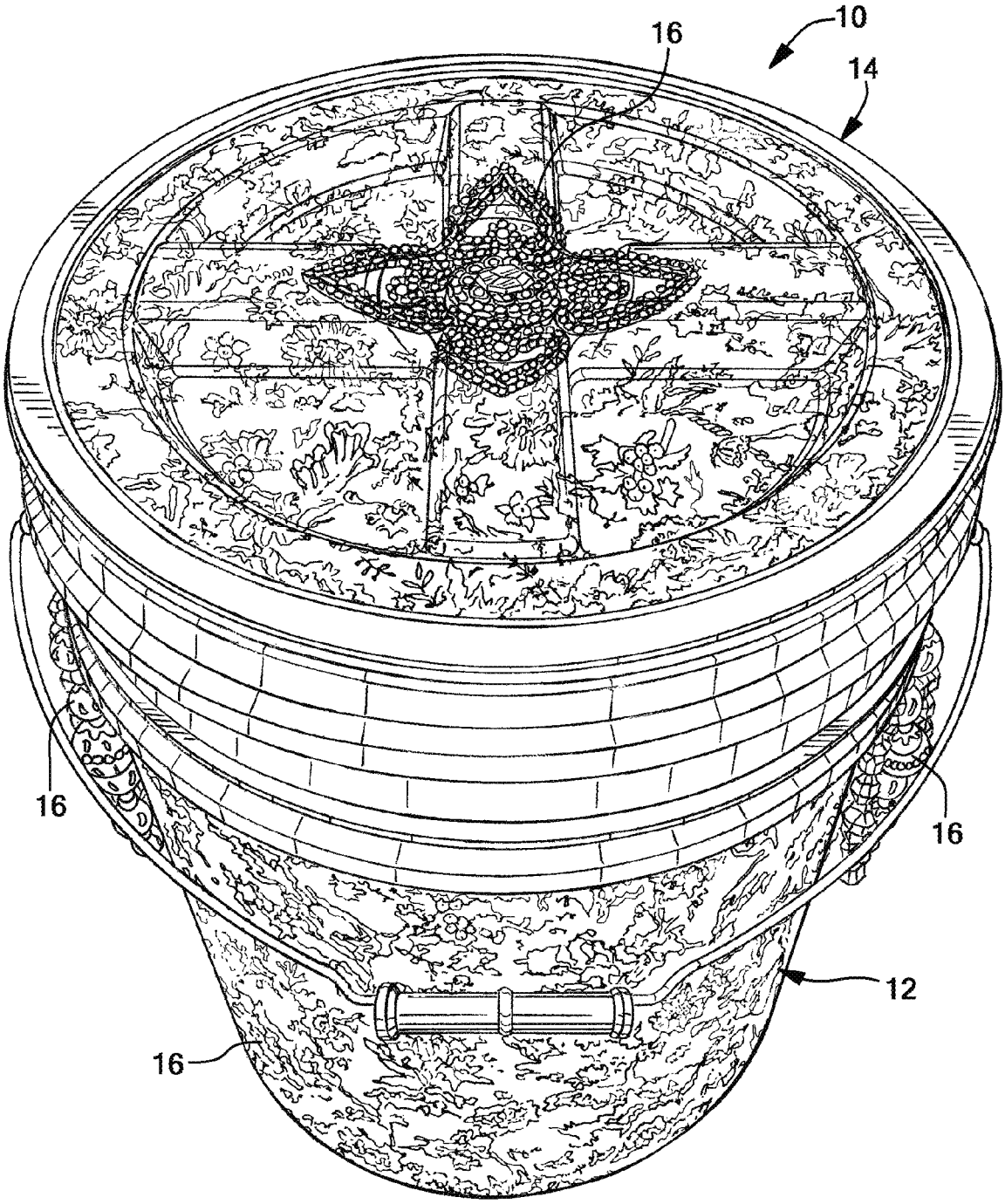
FIG. 1 is a perspective view of a decorative container assembly according to an exemplary embodiment of the invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 discloses a perspective view of a decorative container assembly according to an exemplary embodiment of the present invention, generally designated with the reference numeral 10. As described in greater detail herein, the decorative container assembly 10 can be used to hold or contain items or materials in a variety of different applications. In one exemplary embodiment, the decorative container assembly 10 is a pet food container. As further shown in FIGS. 1-7, the decorative container assembly 10 generally includes a container 12, a lid assembly 14 and a plurality of decorative elements 16 or decorative member 16. The lid assembly 14 is operably removably connected to the container 12. As explained in greater detail below, certain decorative elements 16 are permanently attached to the container assembly 10 and certain other decorative elements 16 are removably attached to the container assembly 10. The decorative elements 16 may be further referred to as decorative embellishments 16 as described in greater detail below.

FIGS. 1-7 show the container 12. The container 12 has a bottom member 18 and a sidewall 20 extending from the bottom member 18. The sidewall 20 extends from the bottom member 18 at a predetermined distance wherein an end of the sidewall 18 defines a rim 22 (FIG. 6) and an opening 24 of the container 20. In an exemplary embodiment, the bottom member 18 is circular and the sidewall is an annular sidewall 20 wherein the opening 24 of the container 12 is circular.

In a further exemplary embodiment, the container 12 is a five-gallon bucket. The container 12 is formed from materials that are food grade safe. In a further exemplary embodiment, the material of the container 12 is a bisphenol (BPA) free material. The material is suitable to be painted and to receive decorative coverings as described in further detail herein. Thus, as further shown in FIGS. 1-3, the sidewall 20 of the container 12 supports or receives a decorative element 16 thereon as further described herein. In particular, the sidewall 20 of the container 12 has a lower segment 26, or central segment 26 that supports a decorative element 16 to be further described. The sidewall of the container 12 further has an upper segment 28, generally adjacent to the lower segment 26. The upper segment 28 receives a decorative element in the form of being painted to be further described. The lower segment 26 has a decorative element 16 adhered thereto in the form of a first decorative member that may have a pattern thereon as will be described in greater detail below. The sidewall 20 has a first support hub 30 and a second support hub 32 proximate the upper segment 28. The first support hub 30 and the second support hub 32 are positioned generally opposite one another or generally 180° apart. The first support hub 30 and the second support hub 32 have respective openings. The openings receive a respective first and second ends of a handle 34 for the container 12. The handle has a grip member 36 positioned at a central location of the handle 34 or intermediate portion of the handle 34. A first stop member 38 is positioned on the handle 34 generally adjacent the first support hub 30, and a second stop member 40 is positioned on the handle 34 generally adjacent the second support hub 32. The stop members 38,40 may be in the form of a narrow tubular member that may fit over the handle in an interference fit. It is further understood that the container 12 can have a plurality of support ribs such as proximate the upper segment 28 of the sidewall 20 of the container 12. It is understood that the handle 34 could have bends or be structured to avoid unwanted engagement or rubbing on the sides of the lid assembly 14. In addition, while the container 12 is a 5-gallon bucket in an exemplary embodiment, the container 12 can have other sizes.

FIGS. 2-4 and 6 show the lid assembly 14. The lid assembly 14 generally includes a ring member 42 and a cover member 44. The ring member 42 is generally an annular member dimensioned to correspond to the rim 22 of the container 12. The ring member 42 defines a generally circular opening 46. The ring member 42 has a resilient rubber gasket 48 (FIG. 7) secured to an inner surface of the ring member 42 proximate a bottom portion or underside of the ring member 42. The gasket 48 engages the surfaces of the sidewall 20 of the container at the rim 22 of the container 12 when the ring member 42 is connected to the container 10 as described in greater detail below. Thus, the gasket 48 is positioned between an inner surface of the ring member 42 and the rim 22 defined by the sidewall 18. The ring member 42 further has a threaded member 50 on an inner surface proximate a top of the ring member 42 and generally adjacent to the gasket 48. The threaded member 50 will be described in greater detail below as well.

As shown in FIGS. 4, 6-7 and 10, the cover member 44 of the lid assembly 14 is a generally circular member having a diameter dimensioned to fit into the circular opening 46 of the ring member 42. The cover member 44 defines an encompassing undulating top surface 52, and the cover member 44 has a depending wall 53. As explained in greater detail below, the depending wall 53 has a threaded member that cooperates with the threaded member 50 of the ring member 42. The undulating top surface 52 generally has an outer lip member 54 and an inner member 55 or inner circular member 55 in one exemplary embodiment. The inner circular member 55 generally has an inner planar surface 56, a cross-member 60 as well as recessed segments in the form of recessed lower floor members 70 and also has curved inner walls 72 to be described in greater detail below. The cross-member 60 is proximate a central portion of the cover member 44. The cross-member 60 has intersecting cross-members and a plurality of recessed segments between the cross-members. The outer lip member 54 is a generally annular member and defines an outer periphery of the cover member 44. The inner planar surface 56 is concentric with the outer lip member 54 and positioned adjacent and within the outer lip member 54. In one exemplary embodiment, the inner planar surface 56 may be recessed with respect to the outer lip member 54. The depending wall 53 has a threaded member 62 (FIGS. 6-7) that mates with the threaded member 50 of the ring member 42 to be described in greater detail below. As further shown in FIG. 10, the cross-member 60 is defined by a pair of members, or a first intersecting member 64 and a second intersecting member 66, that intersect at generally a right angle to further define a central intersection area 68. The cross-member 60 extends from a center of the cover member 44 to the inner planar surface 56. Multiple recessed segments, in the form of lower floor members 70 are located between the intersecting members 64,66. A curved inner wall 72 depends from the inner planar surface 56 to the lower floor member 70 wherein the wall 72 is divided into segments between the first and second intersecting members 64,66 of the cross-member 60. The cross-member 60 can be engaged by a user to secure the cover member 44 to the ring member 42 to be described in greater detail below. As will be explained in greater detail below, the undulating top surface 52 may have different decorative elements or members including a painted layer and/or decorative pattern members.

In an exemplary embodiment, the lid assembly 14 is a gamma seal lid assembly. This type of construction provides a water-tight, leak-proof and air-tight seal of the container 12 when the lid assembly 14 is properly connected and secured to the container 12. Thus, the cover member 44 can be repeatedly attached to and removed from (by screwing and unscrewing the cover member) the ring member 42. It is understood that the lid assembly 14 could take other form including a single member lid. The lid assembly 14 could also take other shapes in addition to a generally circular lid assembly. It is further understood that the container 12 and lid assembly 14 can have complimentary shapes in addition to generally circular or annular configurations. The container 12 and lid assembly 14 can also have different configurations wherein a transition element is used to operably connect the container 12 and lid assembly 14.

As further shown in FIGS. 2-4 and 6 and discussed above, the sidewall 20 of the container 12 has the lower segment 26 adjacent the upper segment 28. The lower segment 26 has a decorative element or decorative member in the form of a first decorative pattern member 80 positioned on the sidewall 22. In an exemplary embodiment, the decorative member is adhered to the sidewall 22 at the lower segment 26. It is understood that the first decorative pattern member 80 can have various patterns or a decorative element that may not be considered a pattern and be a first decorative member 80. In an exemplary embodiment, the first decorative pattern member 80 extends around a full periphery of the lower segment 26 of the sidewall 20 and is adhered thereto. The first decorative pattern member 80 may comprise a single pattern or multiple patterns different from one another. It is understood that the first decorative pattern member 80 may be an integral member or comprise multiple members attached to the container 12. The first decorative pattern member 80 may be positioned around the full periphery of the container 12 and only a portion of the container 12. Thus, the first decorative member 80 may cover a portion of the outer surface of the sidewall 20 or cover an entire outer surface of the sidewall 20. The upper segment 28 of the sidewall 20 also has a decorative element 16 or decorative member in the form of a painted layer 82 and in a color that may generally compliment the first decorative pattern member 80. The first decorative pattern member 80 generally has a pattern associated therewith wherein the pattern may also include solid colored layer if desired. Thus, the first decorative pattern member 80 may be part of a first decorative member that can also include the first decorative pattern member 80 and the painted layer 82 on the upper segment 28. The bottom 18 (FIG. 5) of the container 12 is also painted typically in the same color as the upper segment 28 of the sidewall 20 and thus may be considered to also have the painted layer 82 in an exemplary embodiment. The grip member 36 of the handle 34 is also painted typically in the same color as the upper segment 28 of the sidewall 20 and thus has the painted layer 82 thereon. It is understood that the painted layer 82 among the upper segment 28, the bottom 18 and the grip member 36 could be the same color or different colors. It is understood that the painted portions of the container assembly 10 can be painted in a variety of different colors, in a single color or in multiple colors.

Figure 4:
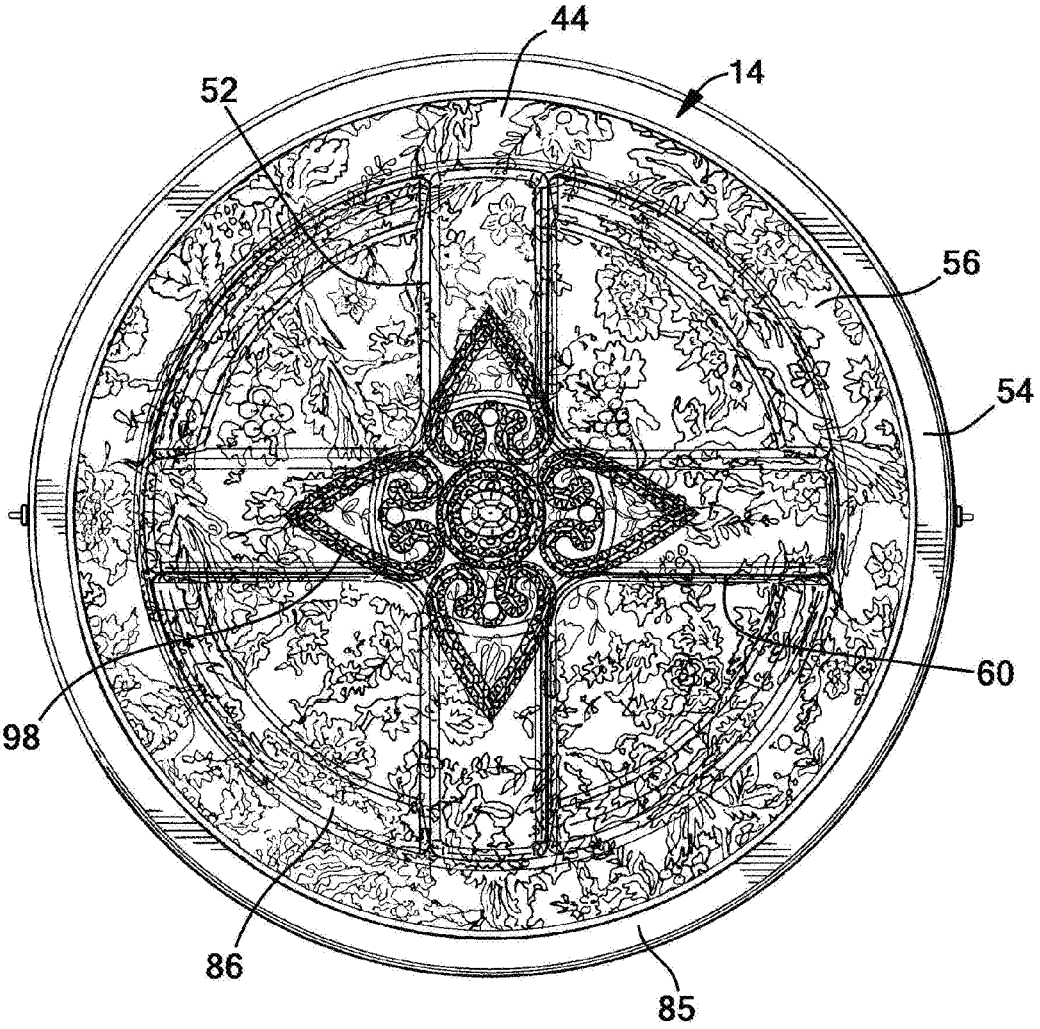
FIG. 4 is a top plan view of the decorative container assembly of FIG. 1.
Figure 5:
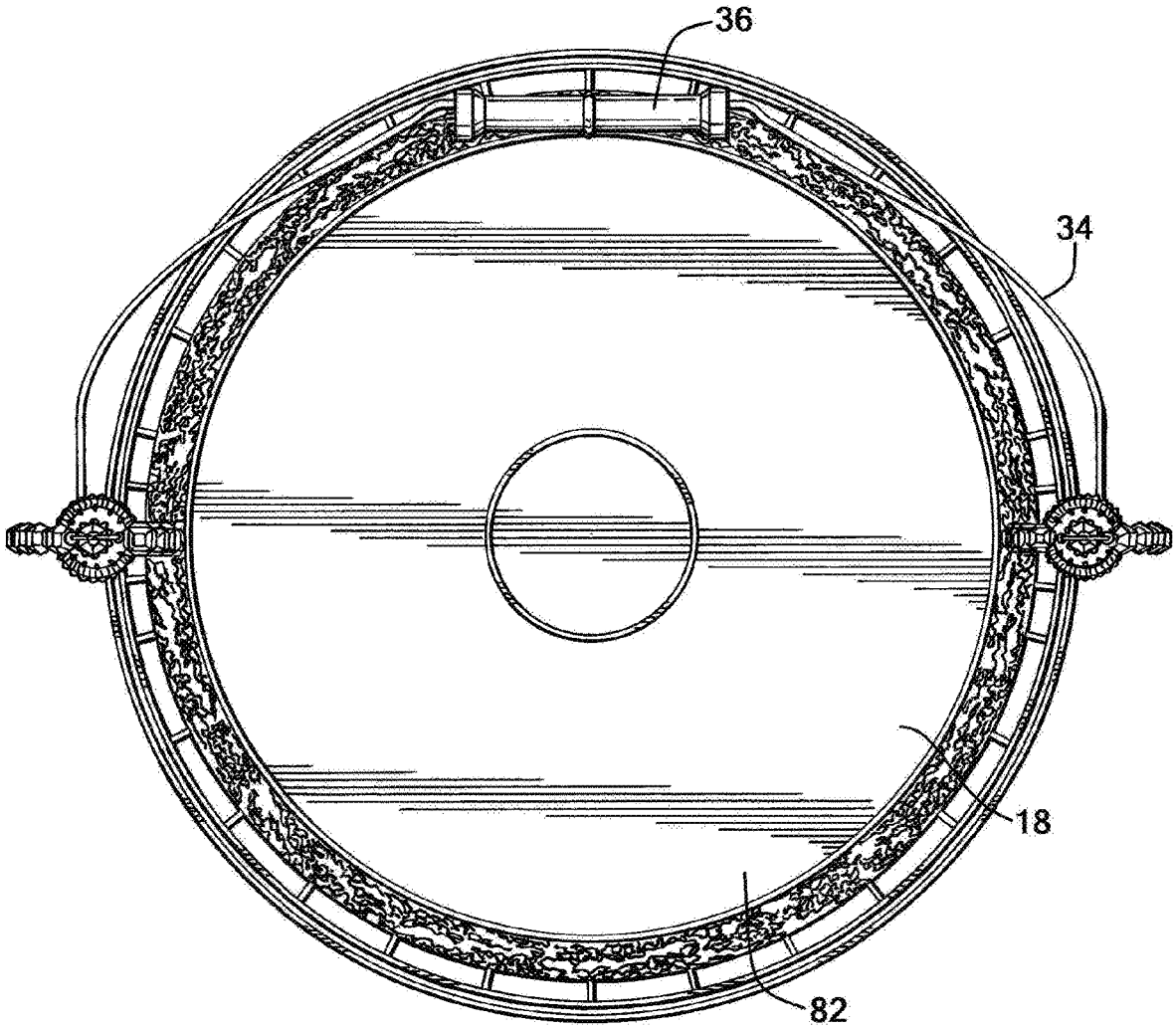
FIG. 5 is bottom plan view of a container of the decorative container assembly of FIG. 1.
Figure 6:
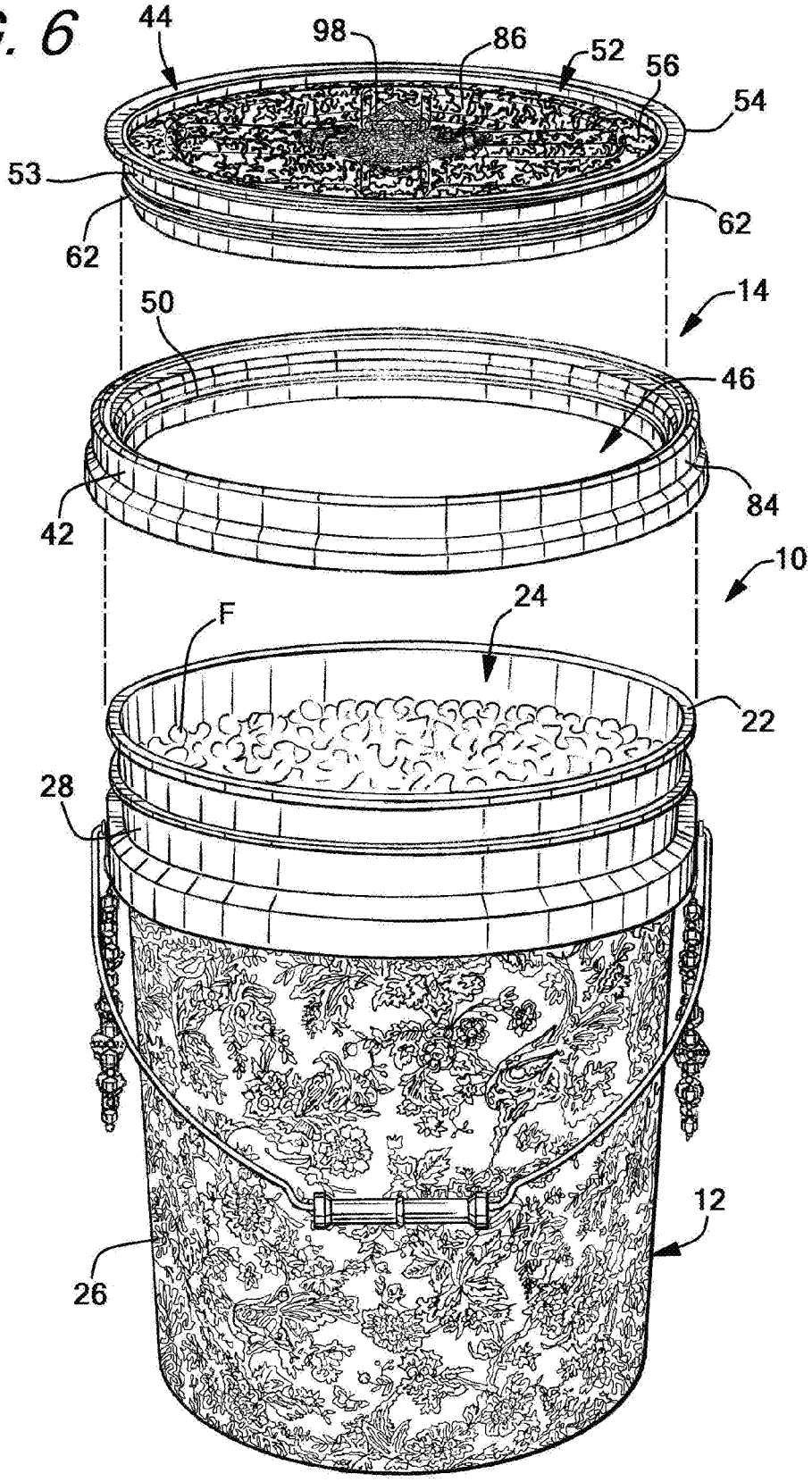
FIG. 6 is an exploded perspective view of the decorative container assembly of FIG. 1.

As further shown in FIGS. 4 and 6, the lid assembly 14 also has decorative features or decorative elements 16 associated therewith. The ring member 42 of the lid assembly 14 has a decorative element 16 thereon in the form of a painted layer 84. In an exemplary embodiment, the ring member 42 is painted in a color that is identical or complimentary to the color used on the painted layer 82 of the upper segment 28 of the sidewall 20 of the container 12. The cover member 44 has a decorative element 16 in the form of a painted layer 84 and/or a second decorative pattern member 86 applied thereon. In an exemplary embodiment, the outer lip member 54 has the painted layer 84 thereon and the inner circular member 55 has the second decorative pattern member 86 that completely covers the exposed surfaces of the inner circular member 55. Thus, the exposed surfaces of the cover member 44 (e.g. when connected to ring member 42 on the container 12) are completely covered by a decorative element 16. Further in an exemplary embodiment, the second decorative pattern member 86 is identical to the first decorative pattern member 80. It is understood, however, that the second decorative pattern member 86 could be different or generally complimentary to the first decorative pattern member 80. As discussed, the second decorative pattern member 86 is positioned on substantially the entire inner circular member 55 which will be described in greater detail below. The entire undulating top surface 52 is covered by the decorative element 16 or decorative member 16 in the form of decorative members such as the painted layer and the second decorative pattern member 86.

Figure 2:
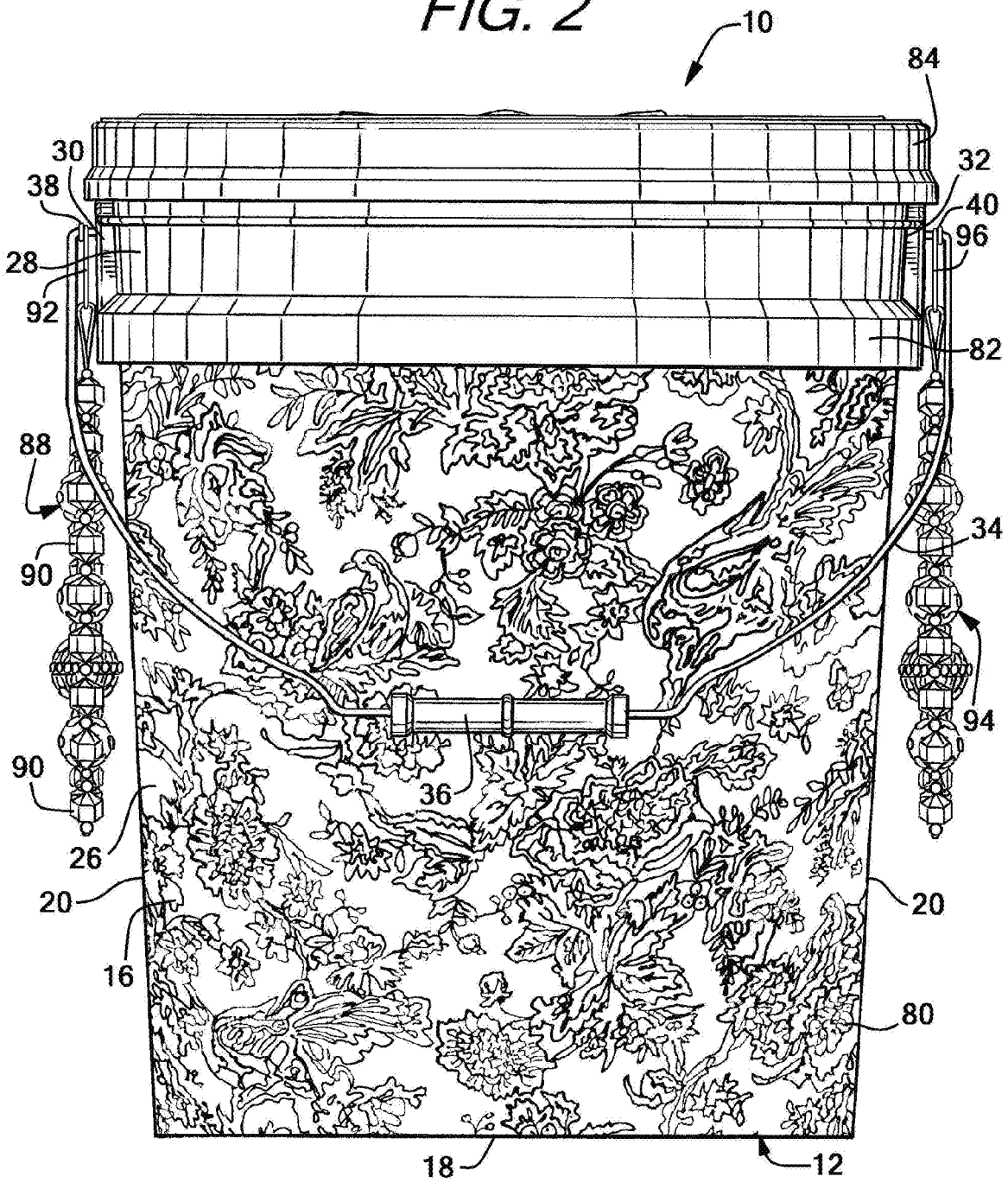
FIG. 2 is a front elevation view of the decorative container assembly of FIG. 1.
Figure 3:
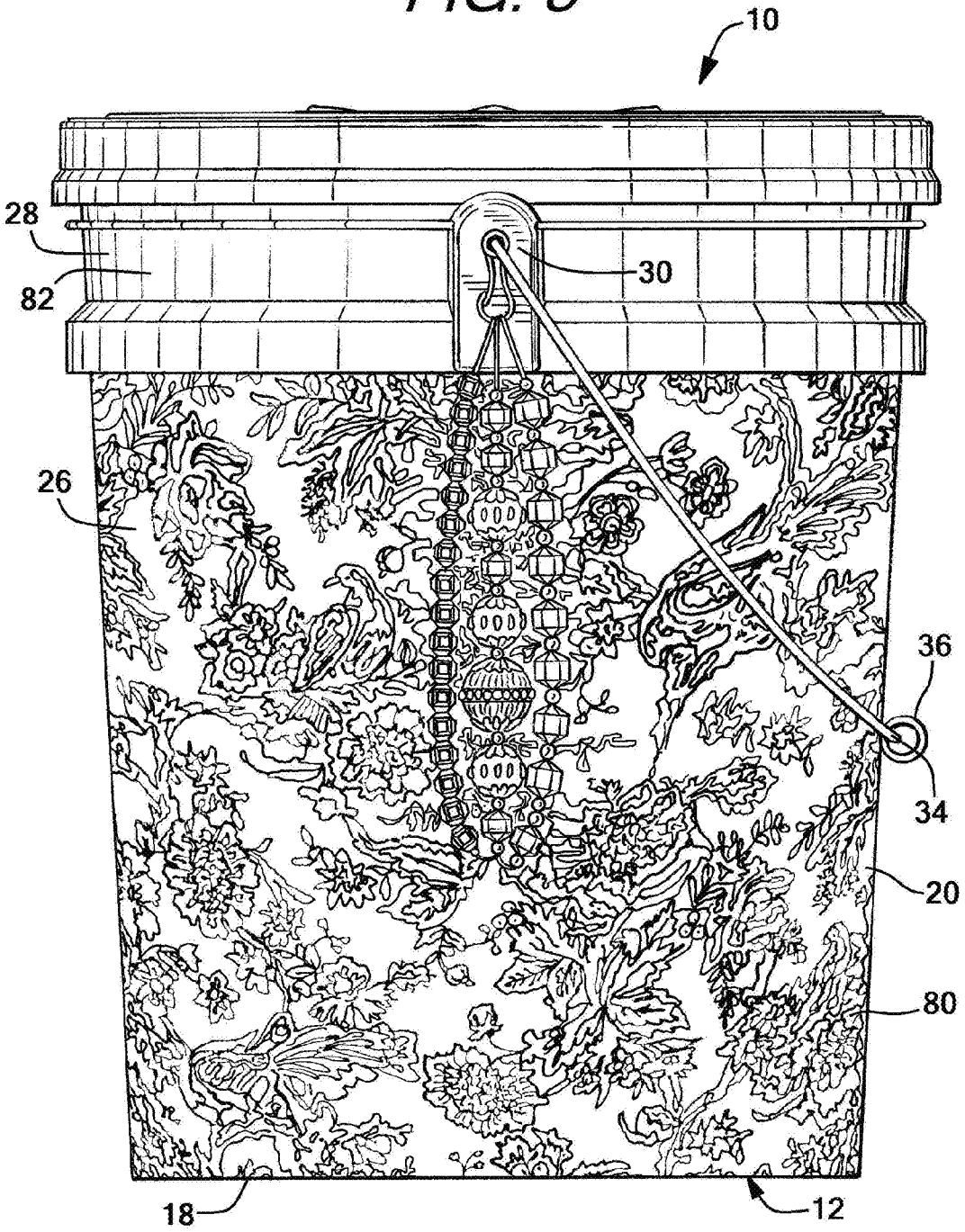
FIG. 3 is a side elevation view of the decorative container assembly of FIG. 1.

FIGS. 2-4, 6, 8 and 9 further show various additional decorative elements 16. The additional decorative elements 16 can take various forms and also be referred to as embellishments 16. The container 12 may have a decorative element 16 in the form of a first earing member 88 or first depending member 88. The first earing member 88 has a plurality of decorative components 90 that depend from a first clasp 92. The decorative components 90 can take various forms including gems, stones, beads or other components. It is further understood that the first earing member 88 may have a single component 90 operably connected to the first clasp 92. The first clasp 92 is designed to be removably attached proximate the first end of the handle 34 and has resiliently moveable member as is known in the art to receive the handle 34. The first clasp 92 is connected to the first end of the handle 34 generally between the first support hub 30 and the first stop member 38. As shown in FIG. 2, with the first clasp 92 so positioned, the decorative components 90 depend or hang down from the first clasp 92 adjacent to the sidewall 20 of the container 12. The container 12 may also have another decorative element 16 in the form of a second earing member 94. The second earing member 94 has a plurality of decorative components 90 that depend from a second clasp 96. It is further understood that the second earing member 94 may have a single component 90 operably connected to the second clasp 96. The second clasp 96 is designed to be removably attached proximate the second end of the handle 34. The second clasp 96 is connected to the second end of the handle 34 generally between the second support hub 32 and the second stop member 40. As shown in FIG. 2, with the second clasp 96 so positioned, the decorative components 90 depend or hand down from the second clasp 96 adjacent to the sidewall 20 of the container 12. It is understood that the first and second clasps 92,96 can take various forms and are designed to be able to be removably attached to the handle 34 of the container 12. It is understood that the first earing member 88 could be the same as or different from the second earing member 94. The first and second earing members 88,94 may also be referred to as decorative embellishments or depending decorative elements. The container 12 could also have various other decorative elements attached thereto such as beading or ribbons etc. as described further below. The attachment could either be a permanent attachment or a removable attachment. It is further understood that the earing members 88,94 could depend or be hung from other locations such as from the respective support hubs 30,32 of the container 12.

Figure 8:
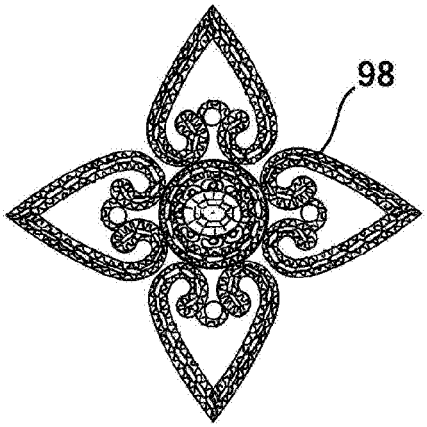
FIG. 8 is a top plan view of a decorative element used in the decorative container assembly of FIG. 1.
Figure 9:
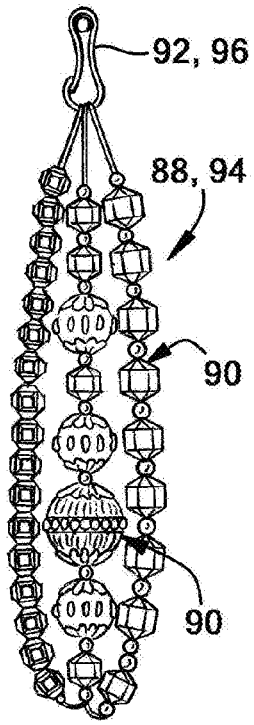
FIG. 9 is a side elevation view showing another decorative element configured to be removably connected to a handle of the container.
Figure 10:
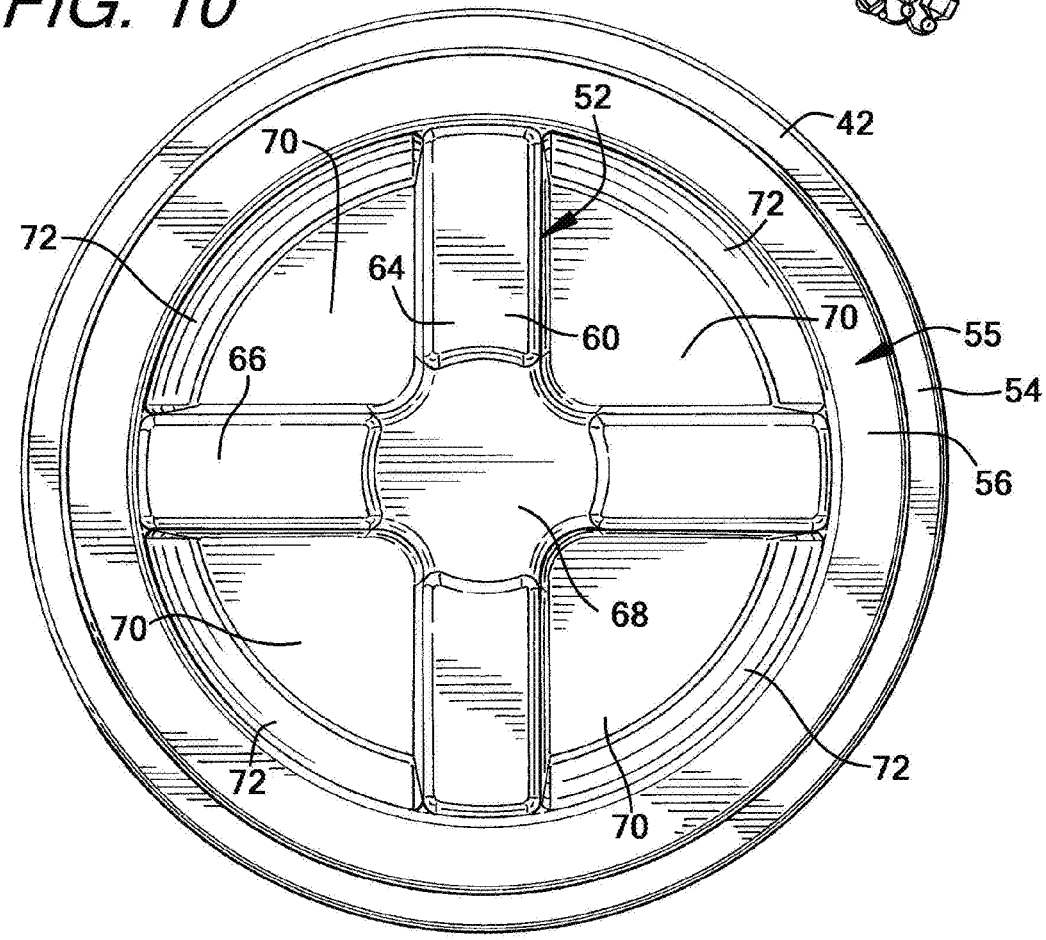
FIG. 10 is a top plan view of the lid assembly.

The lid assembly may also have a decorative element 16 associated therewith. As shown in FIGS. 4, 6 and 8, the lid assembly 14 has a third decorative embellishment 98 attached thereto. The third decorative embellishment 98 is attached at the central intersection area 68 of the cover member 44 of the lid assembly 14. The third decorative embellishment 98 may have a plurality of components that extend along the cross-member 60 of the cover member 44. The attachment of the third decorative embellishment to the lid assembly 14 is permanent in an exemplary embodiment although the third decorative embellishment 98 could also be removably attached to the cover member 44 if desired.

As discussed, the container 12 can take various forms and in an exemplary embodiment may be a traditional five-gallon bucket. The steps taken in forming the decorative container apply to any of the various types of containers. A white primer is first sprayed on an inside of the container 12. The upper segment 28 of the sidewall 20 is painted in a desired color to form the painted layer 82. The bottom 18 of the container 12 as well as the grip member 36 of the handle 34 are also painted in the desired color such as the painted layer 82 or differently-colored painted layer. Thus, in an exemplary embodiment, the color of the upper segment 28 of the sidewall 20, the container bottom 18 and the grip member 36 are painted the same color. The lower segment 26 of the sidewall 20 has the first decorative pattern member 80 applied thereon and adhered thereto in a decoupage process. Thus, the first decorative pattern member 80 is cut from a supply of paper in an appropriate size to cover the lower segment 26 of the sidewall. It is understood an upper edge of the first decorative pattern member 80 may overlap a bottom portion of the painted layer 80 to form a distinct demarcation between the first decorative pattern member 80 and the painted layer 82 on the upper segment 28. As part of the decoupage process, the second decorative pattern member 80 is affixed or adhered to the sidewall 20 with an adhesive member such as mod podge glue material. Various types of mod podge glue can be used and in an exemplary embodiment the glue may provide the adhesive, sealer and finish all together. A clear coat of acrylic material is applied to the container over the first decorative pattern member 80 as well as the painted layer 82 as well as other painted portions of the container 12. A clear coat of polyurethane material may also be applied to these portions of the container 12. Furthermore, a combination of the acrylic material and polyurethane material could also be applied to the container in a clear coat. It is understood that the clear coat is virtually undetectable to the naked eye and the drawings are understood as showing the container 12 having the clear coat thereon. The clear coats can also be a gloss finish or a flat or matte finish. As described above, the container 12 has portions that have painted layers thereon and portions having the decorative pattern member thereon. As can be appreciated from the discussion herein, the first decorative member 16 can broadly include a painted layer such as the painted layer 82 and the first decorative pattern member such as the first decorative pattern member 80.

The lid assembly 14 has decorative elements 16 or decorative members associated therewith and has portions that are painted and portions having the second decorative pattern member 86 applied thereto. Similar to the container 12, the second decorative member 16 associated with the lid assembly 14 can broadly include painted layers and decorative pattern members as further described herein. The ring member 42 and the cover member 44 first have a white primer sprayed thereon similar to the container 12. The ring member 42 of the lid assembly 14 is painted a desired color to form the painted layer 84 of the ring member 42 which may be the same color as the painted layer 82 on the upper segment 28 of the sidewall 20 of the container 12 in an exemplary embodiment. As discussed above, the undulating top surface 52 of the cover member 44 has the decorative element 16 or decorative member 16 applied thereon. The outer lip member 54 is painted to form a painted layer 85 thereon. The painted layer 85 may be in the same color as the painted layer 82 on the upper segment of the side wall 18 and/or the painted layer 84 on the ring member 42. The inner circular member 55 has the second decorative pattern member 86 applied thereto. The application process is performed according to a plurality of sequential steps as described below. The steps provide a method of forming a decorative lid assembly for a decorative container assembly.

Figure 11:
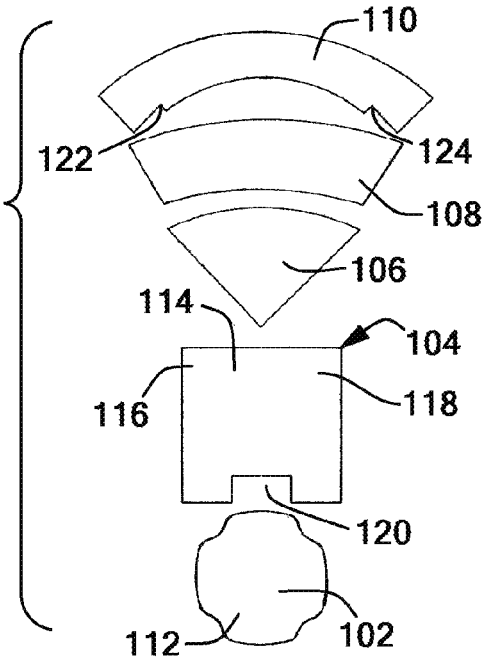
FIG. 11 is a top plan view of a plurality of stencil members for a template wherein the stencil members are used to form various members to cover a cover member of the lid assembly.

It is understood that a supply of material having the second decorative pattern member thereon, is provided. As shown in FIG. 11, several stencil members are provided to form a template, namely, an intersection stencil 102, a cross-member stencil 104, a floor member stencil 106, an inner sidewall stencil 108 and an top planar surface stencil 110. As further shown in FIG. 11, the intersection stencil 102 has a central, generally squared member that has an extension member 112 from each side. The cross-member stencil 104 has a central section 114 positioned between a first section 116 and a second section 118. The central section 114 has a cut-out portion 120 at a distal end. The floor member stencil 106 is generally in the shape of a quadrant of a circle wherein the stencil 106 is shaped by two radii, that are perpendicular to each other, and an arc. The inner sidewall stencil 108 is generally four-sided and slightly curved. The top planar surface stencil 110 is also four-sided and slightly curved and having a first notch 122 at a first distal end and a second notch 124 at a second distal end. FIG. 11 shows the intersection stencil 102, the cross-member stencil 104, the floor member stencil 106, the inner sidewall stencil 108 and the top planar surface stencil 110. It is understood that a single cross-member stencil 104, single floor member stencil 106, single inner sidewall stencil 108 and single top surface stencil 110 could be used to form multiple members, although multiple, respective stencil members could also be used.

Figure 12:
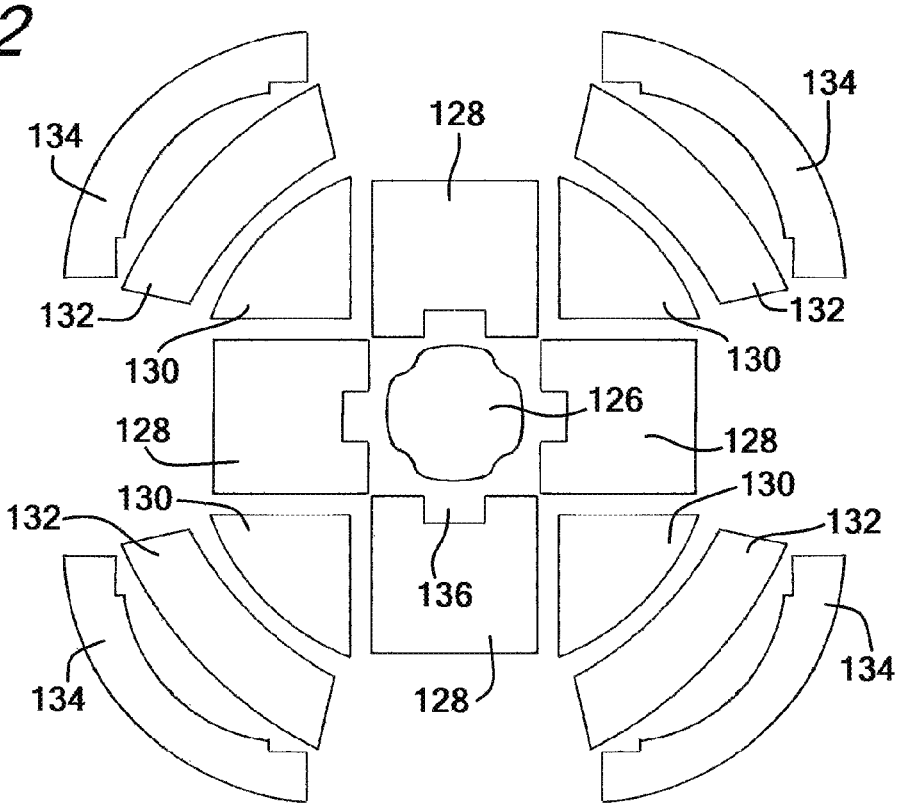
FIG. 12 is a top plan view of a plurality of members cut from the stencil members used to cover the cover member of the lid assembly.

As further can be appreciated from FIGS. 11 and 12, the intersection stencil 102 is used to trace the shape of a single intersection member 126 on the supply of the material wherein the intersection member 126 is cut from the supply of material. Each of the cross-member stencil 104, the floor member stencil 106, the inner sidewall stencil 108 and the top surface stencil 110 are used to trace the shape of four respective members on the supply of material. Thus, the cross-member stencil 104 is used to trace the shape of four cross-member members 128 on the supply of material wherein four cross-member members 128 are cut from the supply of material. The floor member stencil 106 is used to trace the shape of four floor members 130 on the supply of material wherein four floor members 130 are cut from the supply of material. The inner sidewall stencil 108 is used to trace the shape of four inner sidewall members 132 on the supply of material wherein four inner sidewall members 132 are cut from the supply of material. The top planar surface stencil 110 is used to trace the shape of four top planar surface members 134 on the supply of material wherein four top planar surface members 134 are cut from the supply of material. Because of the shape and symmetrical features of the cover member 44, these four stencils 104,106,108,110 can be used for the respective four members 128,130,132, 134 from each stencil. The respective four members 128, 130,132,134 are cut from the supply of material. While FIG. 12 shows the seventeen total members cut from the supply of material. It is understood that the layout of the stencils and/or order the members are cut from the supply of material may be arranged and sequenced on the supply of material to minimize any wasted material. While FIG. 12 shows the members more in schematic form, it is understood that the members in FIG. 12 will have the patterned member to form the second decorative pattern member 86 such as shown in FIG. 4.

Figure 13:
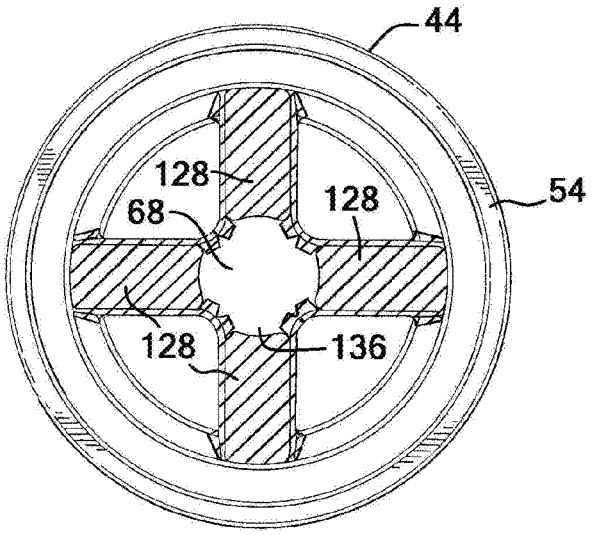
FIGS. 13-17 show a progression of the members cut from the stencil members and affixed to the cover member of the lid assembly.
Figure 14:
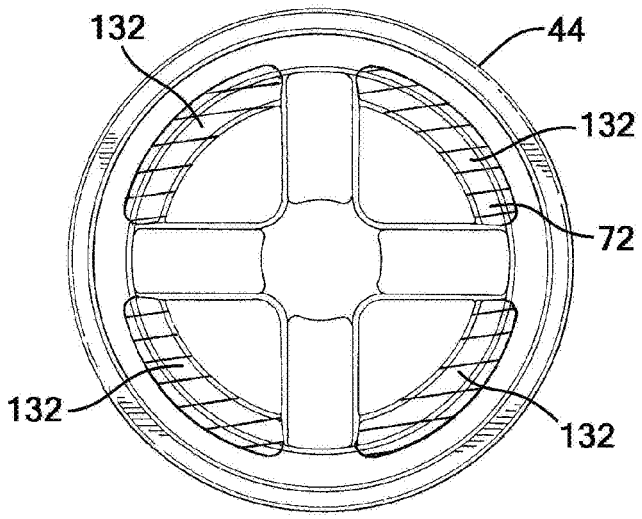
Figure 15:
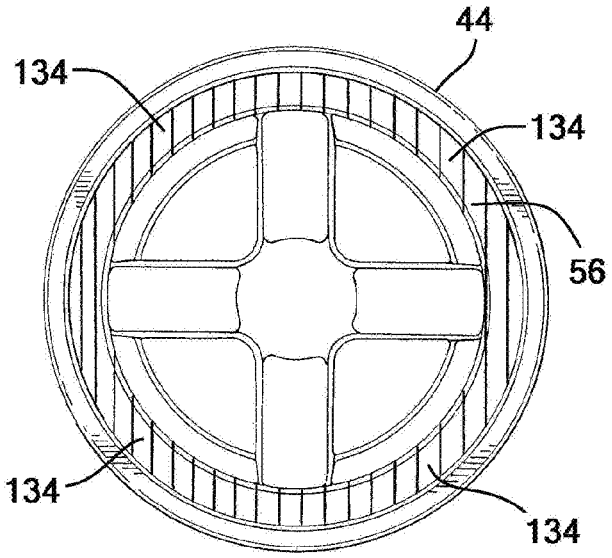
Figure 16:
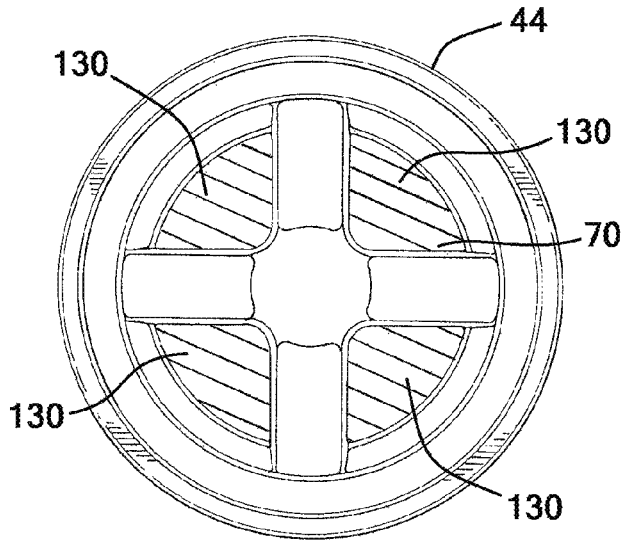
Figure 17:
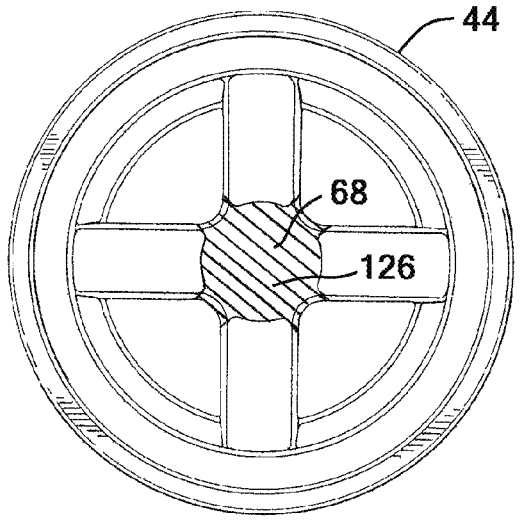

FIGS. 13-17 show a progression of application of the second decorative pattern member 86 to the cover member 44. For increased clarity, only one of the members is shown in each Figure while it is understood that the members cut from the supply of material are applied sequentially until the cover member 44 covered. As further shown in FIG. 13, the outer lip member 54 is painted wherein the painting extends into the inner planar surface. The outer lip member 54 may be painted in the same color as the annular ring member 42 of the lid assembly 14 although different colors can be used if desired. As further shown in FIG. 13, a first cross-member member 128 is adhered to one segment of the cross-member 60 of the cover member 44. The cut-out portion 136 of the cross-member member 128 is positioned generally at the central intersection area 68 of the cross-member 60. The remaining cross-member members 128 are also adhered to a respective segment of the cross-member 60 in a similar fashion as shown in FIG. 13. As shown in FIG. 14, the inner sidewall members 132 are then adhered to the respective segments of the curved inner side wall 72 of the cover member 44. (As discussed, the cross-member members 128 are not shown in FIG. 14 for clarity but it is understood the members 128 would be present.) As shown in FIG. 15, the top planar surface members 134 are then adhered to the inner planar surface 56 of the cover member 44. As further shown in FIG. 16, the floor members 130 are adhered to respective recessed lower floor members 70 of the cover member 44. Finally, as shown in FIG. 17, the intersection member 126 is then adhered to the central intersection area 68 of the cross-member 60. The cover member 44, therefore, has the second decorative pattern member 86 adhered thereto in a substantially seamless fashion which is aesthetically pleasing to a user as shown in FIGS. 4 and 6. It is understood that the second decorative pattern member 86 is on the inner member 55 and formed collectively of the intersection member 126, four cross-member members 128, four floor members 130, four inner sidewall members 132 and four top surface members 134. With the combination of the painted layer 85 on the outer lip member 54 and the second decorative patterned member 86 on the inner member 55, the entire undulating top surface 52 is covered in an exemplary embodiment. The third decorative embellishment 98 can then be secured to the cover member 44 proximate the central intersection area 68. As further shown in FIGS. 1 and 4, the third decorative embellishment 98 has portions that extend from the central intersection area 68 and along the first intersecting member 64 and the second intersecting member 66.

Figure 7:
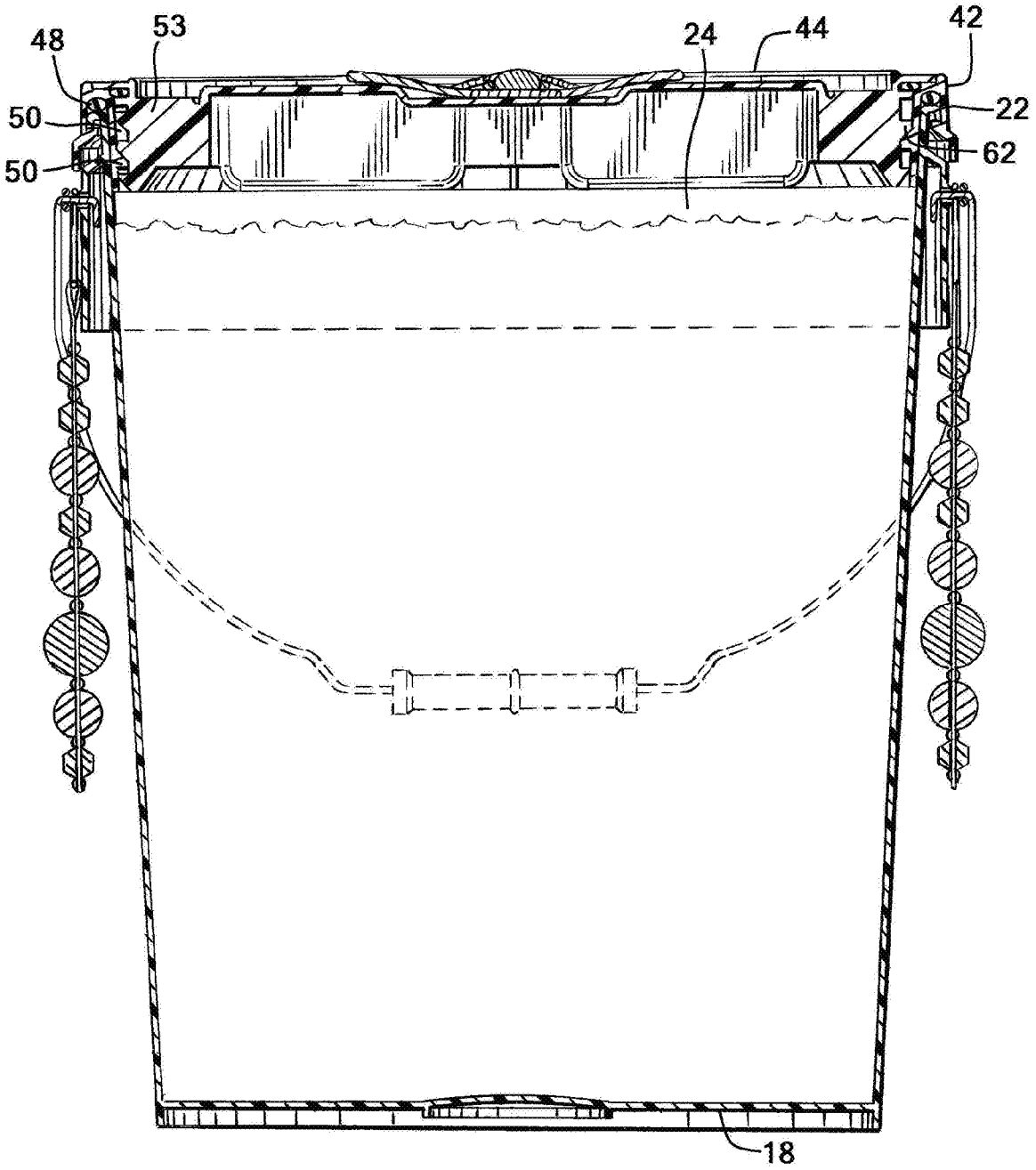
FIG. 7 is a cross-sectional view showing a lid assembly connected to the container of the decorative container assembly of FIG. 1.

FIGS. 1-7 show an exemplary embodiment of a completed decorative container assembly 10. The container 12 is painted with the painted layer and has the first decorative pattern member 80 applied thereon as described above. The first earing member 94 is connected to the handle 34 wherein the first clasp 92 is secured to the handle 34 between the first support hub 30 and the first stop member 38. The second earing member 94 is connected to the handle 34 wherein the second clasp 96 is secured to the handle 34 between the second support hub 32 and the second stop member 40. The lid assembly 14 is secured to the container 12. The ring member 42 is pressed onto the rim 22 of the container 12 and is secured into place on the rim 22 defining the opening 24 of the container 12. As shown in FIG. 7, an air-tight and water-tight seal is formed between the container 12 and the ring member 42. The cover member 44 is removably connected to the container 12 wherein the cover member 44 is screwed onto the container 12 wherein the threaded member 62 on the cover member 44 mates with the threaded member 50 of the ring member 42. An air-tight and water-tight seal is formed between the cover member 44 and the ring member 42.

With such construction, the decorative container assembly 10 can be used to store a variety of materials. In one exemplary embodiment, pet food F (FIG. 6) is contained in the decorative container assembly 10, and thus forms a decorative pet food container assembly 10. The container 12 can be filled with pet food F. The lid assembly 14 is operably removably connected to the container 12. In one exemplary embodiment, a user unscrews the cover member 44 from the ring member 42 to access the pet food F. Once an amount of pet food F is removed from the container 12, the cover member 44 is screwed back onto the ring member 42. The decorative container assembly 10 thus has many utilitarian uses and can store a variety of different materials. Typical utility containers, however, are plain and not aesthetically pleasing to a user or other person viewing the container assembly 10. Thus, such containers are typically stored away in a closet or cabinet as it could be considered an "eyesore" in a home or office for example. With the decorative features of the container assembly 10, the container assembly 10 can be placed in a prominent location of a home or office and otherwise not kept hidden from view.

Figure 18:
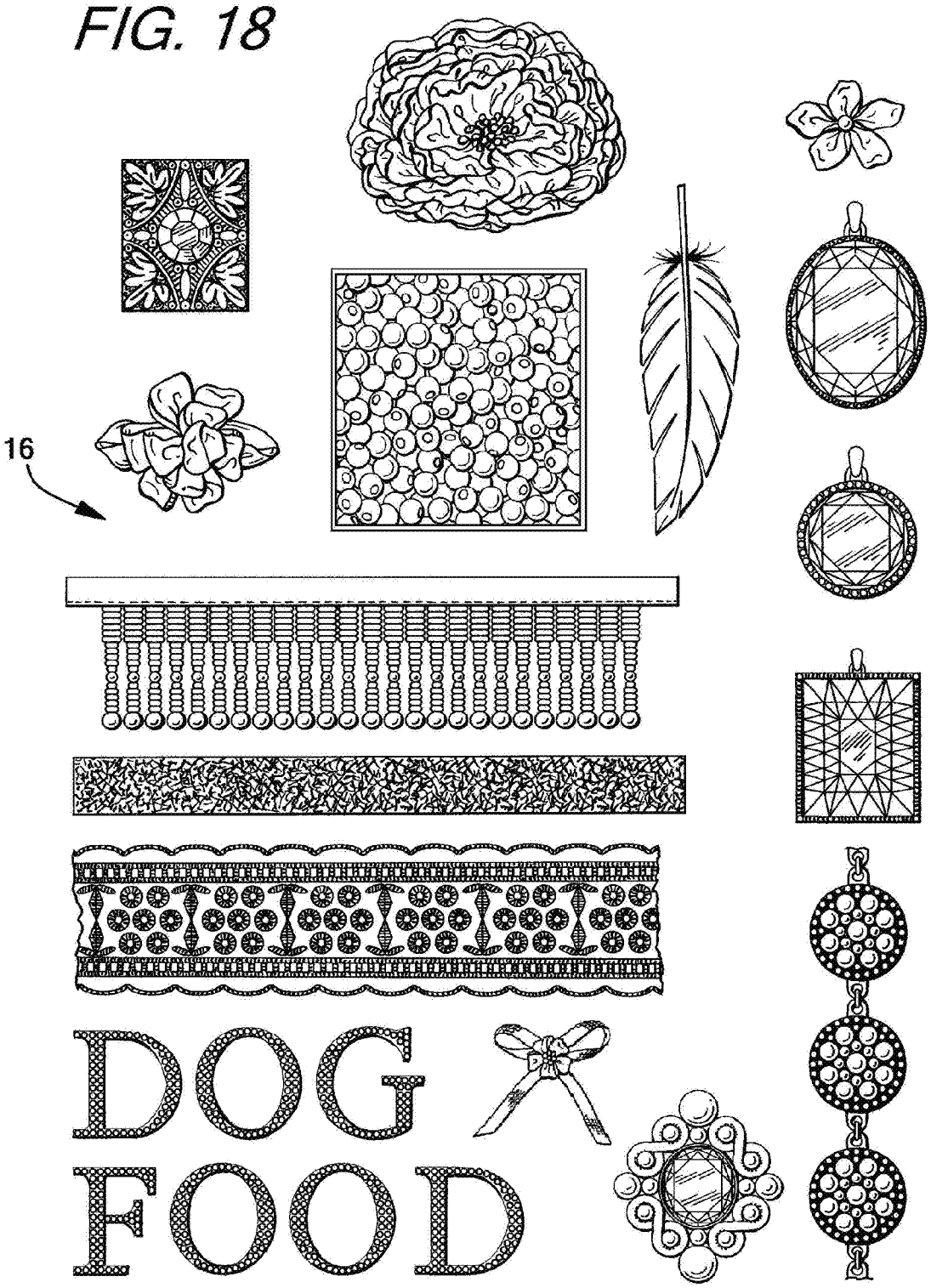
FIG. 18 is a schematic view of a plurality of different types of decorative elements capable of being used in the decorative container assembly of the present invention.
Figure 19:
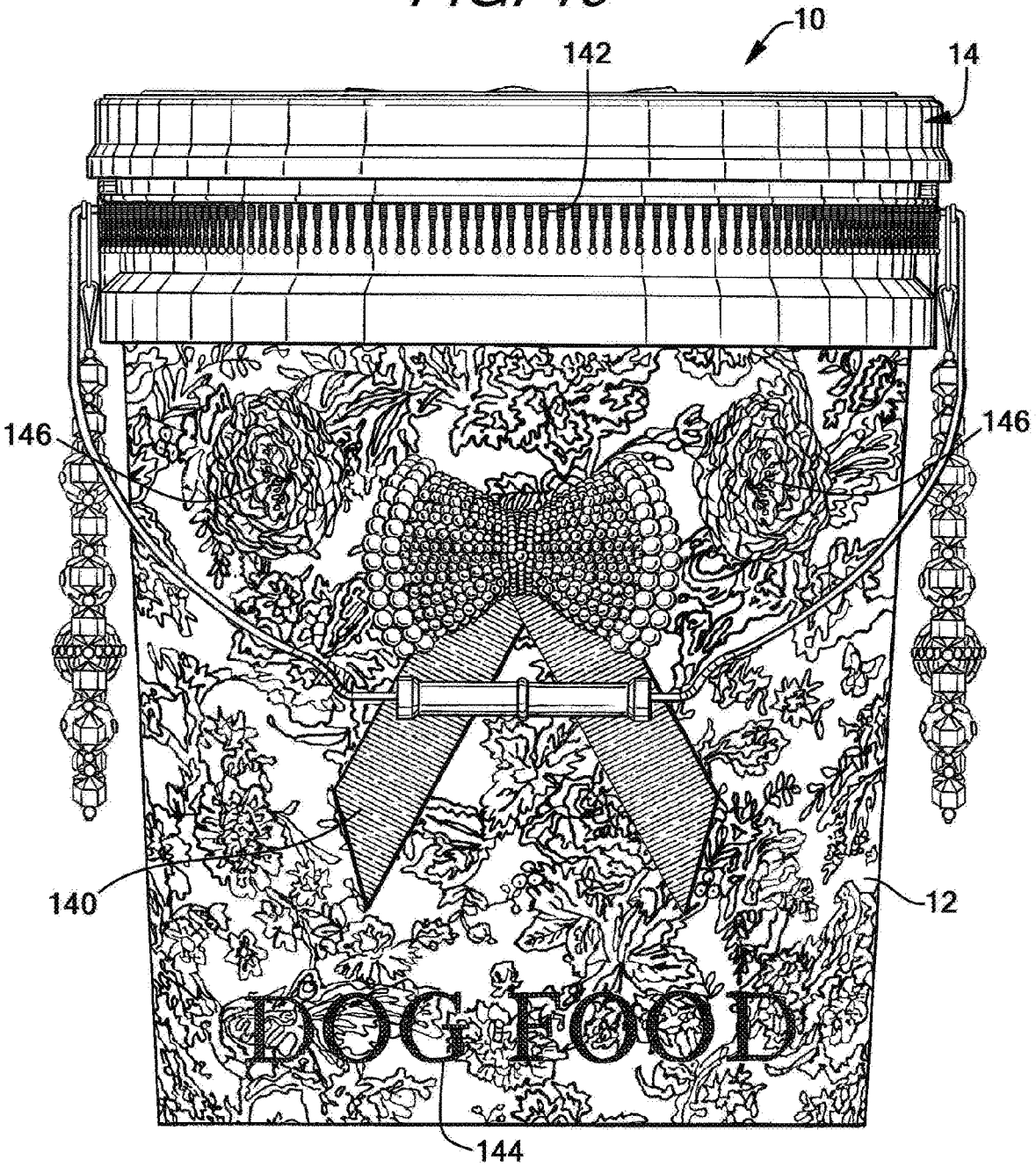
FIG. 19 is front elevation view of an alternative embodiment of a decorative container assembly according to an exemplary embodiment of the present invention and having alternative or additional decorative elements.

It is understood that the decorative container assembly 10 can encompass many different variations and embodiments. The various decorative features can be changed as desired. For example, the color of the painted portions can be changed. The first decorative pattern member 80 and the second decorative pattern member 86 can take various forms. The decorative elements 16 can also take various forms and be attached at different locations of the container assembly 10. The decorative elements 16 can also take the form of elastic ribbons that are removably attached to the container 12 and/or the lid assembly 14. The decorative element 16 could also take the form of sparkle members applied to the container and/or the lid assembly 14. Yet other decorative elements 16 in the form of different types of embellishments can be attached to the container assembly 10 such as: acrylic gems, appliques (embroidered, beaded, sequined, rhinestone or crystal), letter appliques of entire alphabet, other character, numeral or symbol related appliques, beads, sequins, brooches, buttons, buckles, bows, ribbons, feathers, flowers (silk or fabric), lace, rhinestones, crystals and trim members such as beaded fringe members or fabric fringe. The fringe members may have an elastic base that can be removably attached around a circumference of the container 12 and having other elements hanging therefrom. FIG. 18 shows a plurality of these various other types of decorative elements 16 that can be used with the decorative container assembly 10. FIG. 19 discloses an alternative embodiment of the decorative container assembly 10 utilizing other or additional decorative elements 16. The container assembly 10 has the various decorative pattern members and painted layers as previously described, as well as other decorative elements such as the hanging earrings. In this embodiment, the decorative container assembly 10 also utilizes a bow/ribbon 140, an elastic fringe member 142 having hanging members as well as letter appliques 144 that spell out "DOG FOOD." The decorative container 12 further has a pair of flowers 146 connected to the sidewall of the container 12. It is understood that the decorative container assembly 10 can take further other alternative forms such as utilizing other decorative elements such as shown in FIG. 18 and in various combinations. In further exemplary embodiments, it is understood that the appliques 144 can be changed from letters that spell out "DOG FOOD" to other letters, numerals or symbols that display other indicia or messages.

Figure 20:
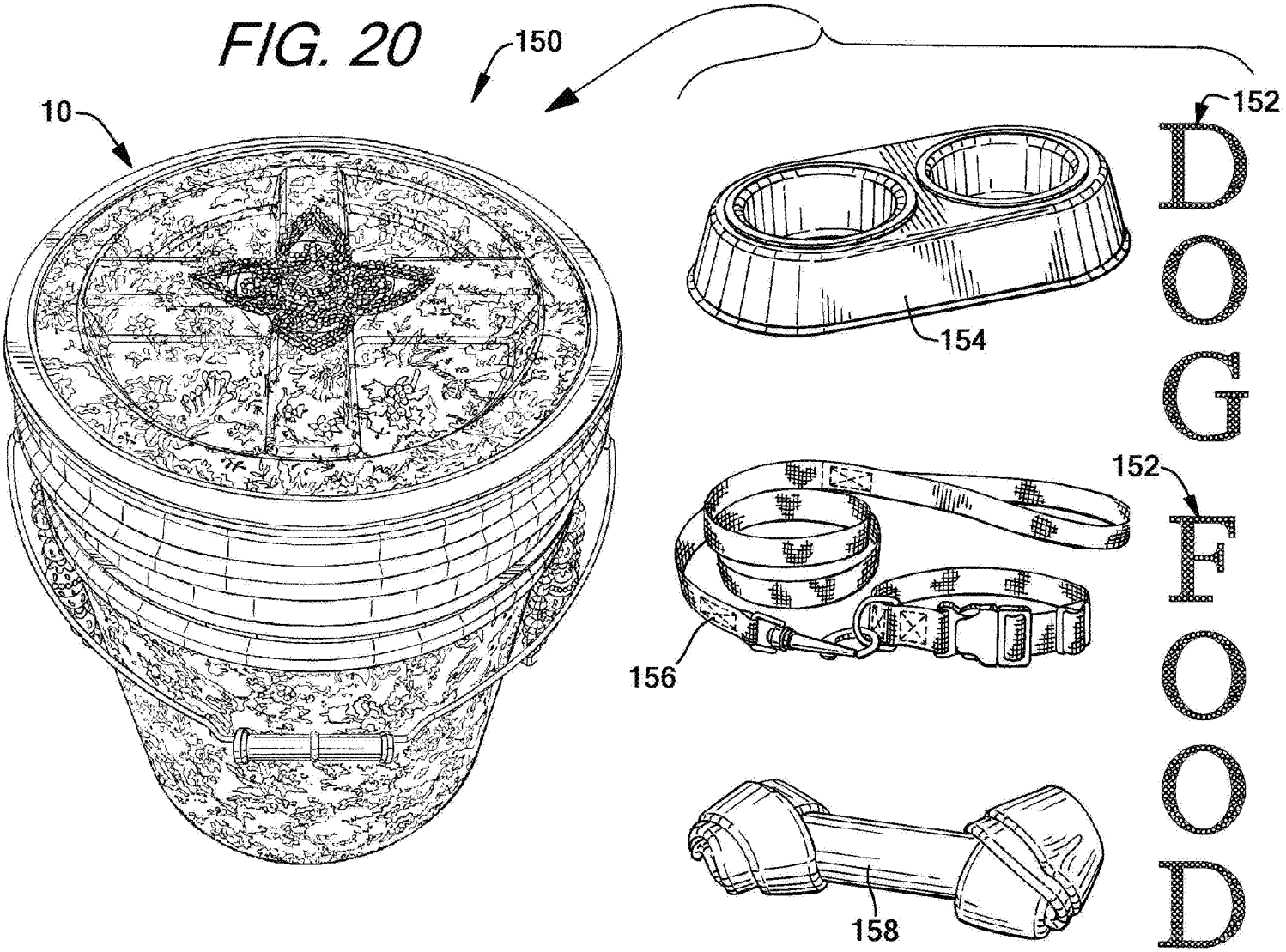
FIG. 20 is a schematic perspective view of a decorative container assembly in the form of a kit having additional components.

In an additional exemplary embodiment, the decorative container assembly 10 can take the form of a kit. The kit may include the decorative container 12 and lid assembly 14 along with a plurality of decorative elements 16 and other components. The decorative container 12 may include a decorative pattern member and painted portions. The kit includes the various decorative elements 16. For example, the kit could include multiple pairs of earrings and lid decorative elements that can be removably attached to the lid assembly 14. With the various decorative elements 16, a user can removably attach the elements 16 as desired and store the elements not used away for future display when the user wishes to change the aesthetic look of the decorative container 12. The various components of the kit could also be categorized into various types of themed articles such as a sport-based kit, holiday kit, a wedding related kit or seasoned based kit. For example, the kit could include decorative elements that include elements associated with a city's various professional sports teams wherein the elements could be removably attached to the container depending on which sports team is in-season. The kit could include a seasonal group of decorative elements that can be removably attached based on each season of the year, e.g. fall, winter, spring and summer. The kit could further include the decorative container that is filled with other pet-related items such as food and water bowls or dishes and animal toys such as chew toys, scratching post etc. In such pet-related kits, the decorative elements could include figurines or a desired pet such as a dog or cat. FIG. 20 shows one exemplary embodiment of a pet-related themed kit for dogs. The kit 150 includes the decorative container assembly 10 having various decorative elements 16 including letter appliques 152 that spell out "DOG FOOD." The kit 150 further includes additional components that may relate to pet dogs such as a pet food dish 154, a dog leash 156 and a chew toy 158. All of these components or some of the components and elements can be contained in the decorative container assembly 10 and sold or presented as a unit or kit 150.

The decorative container assembly 10 of the present invention provides several benefits. The decorative container assembly provides a container for use in a variety of different applications that is more aesthetically pleasing for users than traditional utilitarian containers. The material of the container, such as food grade safe materials or bisphenol-free materials, makes the container ideal for use as a pet food container as well as various other applications. The lid assembly provides an air-tight and water-tight enclosure to help preserve contents, especially in a pet food container application. The lid assembly can be removed and reattached easily as desired. In addition, the lid assembly assists in keeping the aroma of the contents of the container within the container. While the container aptly serves various utilitarian purposes, the container assembly is aesthetically pleasing to the eye. Accordingly, the container assembly does not need to be stored away from view. The container assembly can be stored in view because of the decorative features of the container assembly. In addition, the elements of the decorative container assembly are water-resistant and safe from general heat exposure. A user can easily change the aesthetic look of the container assembly 10 with the various types of decorative elements 16 associated with the container assembly 10.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A decorative pet food container assembly comprising:

a container having a bottom member and an annular sidewall extending from the bottom member, an end of the annular sidewall defining a rim and an opening of the container;

a first decorative member adhered to an outer surface of the sidewall;

a lid assembly operably removably connected to the rim of the container;

a second decorative member adhered to the lid assembly; and a handle having a first end connected to the sidewall at a first position and a second end connected to the sidewall at a second position, the first position being generally opposite to the second position.

2. The decorative pet food container assembly of claim 1 further comprising a first earing member hanging from the handle proximate the first end of the handle and proximate the sidewall.

3. The decorative pet food container assembly of claim 2 further comprising a second earing member hanging from the handle proximate the second end of the handle and proximate the sidewall.

4. The decorative pet food container assembly of claim 1 wherein the lid assembly has an annular ring member and a cover member, wherein the second decorative member covers a top surface of the cover member.

5. The decorative pet food container assembly of claim 1 wherein the container is a five-gallon bucket made from one of a food grade safe material and a bisphenol-free material.

6. The decorative pet food container assembly of claim 1 wherein an external surface of the bottom member of the container is painted.

7. The decorative pet food container assembly of claim 1 wherein an upper segment of the sidewall of the container is painted.

8. The decorative pet food container assembly of claim 4 wherein the lid assembly is a gamma seal lid wherein the annular ring member and the cover member are not integrally connected.

9. The decorative pet food container assembly of claim 8 wherein the annular ring member is connected to the rim and having a gasket positioned between an inner surface of the ring member and the rim, the cover member being removably connected to the annular ring member by mating threads between the ring member and the cover member, the cover member has intersecting cross-members and having a plurality of recessed segments between the cross-members.

10. The decorative pet food container assembly of claim 4 wherein the annular ring member is painted.

11. The decorative pet food container assembly of claim 1 wherein the first decorative member is a paper-based member adhered to a lower segment of the sidewall in a decoupage configuration.

12. The decorative pet food container assembly of claim 11 wherein the first decorative member is adhered to the sidewall with mod podge glue, and wherein the first decorative member covers an entire lower segment of the sidewall.

13. The decorative pet food container assembly of claim 1 wherein the first decorative member has a pattern thereon and the second decorative member has a pattern thereon.

14. The decorative pet food container assembly of claim 1 wherein the first decorative member has a pattern thereon and the second decorative member has a pattern thereon, wherein the pattern on the first decorative member is identical to the pattern on the second decorative member.

15. The decorative pet food container assembly of claim 1 wherein the first decorative member and the second decorative member having a clear coat layer applied thereon.

16. The decorative pet food container assembly of claim 1 wherein the first end of the handle is connected to the sidewall at a first support hub and the second end of the handle is connected to the sidewall at a second support hub generally opposite to the first end of the handle, and further comprising a first earing member hanging from the handle proximate the first end of the handle and proximate the sidewall, wherein the first earing member has a jewel member attached thereto and a clasp member that is removably attached to the handle.

17. The decorative pet food container assembly of claim 16 wherein the handle has a first stop member positioned on the handle proximate the first end of the handle, the first earing member positioned between the first stop member and the first support hub of the container.

18. The decorative pet food container assembly of claim 4 wherein the cover member defines an undulating top surface having an outer lip member and an inner circular member, wherein the second decorative member includes a painted layer on the outer lip member and a second decorative pattern member positioned on the inner circular member.

19. The decorative pet food container assembly of claim 1 wherein the sidewall has a lower segment and an upper segment, wherein the first decorative member includes a first decorative pattern member on the lower segment and a painted layer on the upper segment.

20. The decorative pet food container assembly of claim 1 further comprising a plurality of decorative elements removably attached to the container assembly.

21. A decorative pet food container assembly comprising:

a five gallon bucket having a bottom member and an annular sidewall extending from the bottom member, an end of the annular sidewall defining a rim and an opening of the bucket, the sidewall having a lower segment and an upper segment, the bucket made from a food grade safe material, the bucket having a handle having a first end and a second end and an intermediate portion therebetween, the first end pivotally connected to the bucket at a first position and the second end pivotally connected to the bucket at a second position, the first position being generally opposite the second position;

a first decorative pattern member adhered to the sidewall and covering the lower segment of the sidewall and wherein the upper segment has a painted layer thereon;

a gamma seal lid operably removably connected to the rim of the bucket, the lid having an annular ring member and a cover member, the annular ring member connected to the rim and having a gasket positioned between an inner surface of the ring member and the rim, the cover member removably connected to the annular ring by mating threads between the ring member and the cover member, the cover member having an outer lip member and an inner member having intersecting cross-members and having a plurality of recessed segments between the cross-members; and a second decorative pattern member adhered to a top surface of the inner member, and wherein the outer lip member has a painted layer thereon and the ring member has a painted layer thereon.

22. The decorative pet food container assembly of claim 21 further comprising a first earing member removably connected and hanging from proximate the first end of the handle, and a second earing member removably connected and hanging from proximate the second end of the handle.

23. The decorative pet food container assembly of claim 21 wherein the painted layers of the upper segment of the sidewall, the ring member and the outer lip member are of the same color.

24. A decorative container assembly comprising:

a container having a bottom member and an annular sidewall extending from the bottom member, an end of the annular sidewall defining a rim and an opening of the container;

a first decorative member adhered to an outer surface of the sidewall;

a lid assembly operably removably connected to the rim of the container;

a second decorative member adhered to the lid assembly;

a handle having a first end connected to the sidewall at a first position and a second end connected to the sidewall at a second position, the first position being generally opposite to the second position;

a first earing member hanging from the handle proximate the first end of the handle and proximate the sidewall, and a second earing member hanging from the handle proximate the second end of the handle and proximate the sidewall.

25. A method of forming a decorative lid assembly for a decorative container, the lid assembly being removably attached to the decorative container, the method comprising the steps of:

providing a cover member of a lid assembly, the cover member having a circular member defining a top planar surface and a cross-member positioned within the circular member, the cross-member defined by a first intersecting member and a second intersecting member that further define a central intersection area and cross-members, the cover member defining a plurality of recessed lower floor segments and plurality of curved inner walls between the first and second intersecting members, providing a plurality of stencils comprising an intersection stencil, a cross-member stencil, a floor member stencil, an inner sidewall stencil, and a planar surface stencil;

providing a supply of decorative material;

using the stencils to trace on the decorative material about the stencils and cutting the decorative material on the tracings to form an intersection member, four cross-member members, four floor members, four inner sidewall members and four top planar surface members;

placing each one of the cross-member members on a respective cross-member;

placing each one of the inner sidewall members on a respective inner sidewall;

placing each one of top planar surface members on a respective part of the top planar surface;

placing each one of the floor members on a respective recessed lower floor segment; and placing the intersection member to the central intersection area.

26. The method of claim 25 wherein the step of placing the intersection member to the central intersection area is performed before the placing steps of the cross-members, the inner sidewall members, the top planar surface members and the floor members.

* * * * *